US008505890B2

(12) United States Patent
Toya

(10) Patent No.: US 8,505,890 B2
(45) Date of Patent: Aug. 13, 2013

(54) MEDIUM SUCTION SUPPORT DEVICE AND MEDIUM CONVEYING DEVICE

(75) Inventor: Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 356 days.

(21) Appl. No.: 13/085,010

(22) Filed: Apr. 12, 2011

(65) Prior Publication Data

US 2011/0253763 A1 Oct. 20, 2011

(30) Foreign Application Priority Data

Apr. 14, 2010 (JP) ..... 2010-092934

(51) Int. Cl.
*B25B 11/00* (2006.01)

(52) U.S. Cl.
USPC ..... 269/21; 248/363; 347/104

(58) Field of Classification Search
USPC ..... 269/21; 248/363; 347/16, 104
See application file for complete search history.

(56) References Cited

U.S. PATENT DOCUMENTS

| | | | | |
|---|---|---|---|---|
| 4,049,484 | A * | 9/1977 | Priest et al. | 156/285 |
| 5,374,021 | A * | 12/1994 | Kleinman | 248/362 |
| 6,270,074 | B1 * | 8/2001 | Rasmussen et al. | 271/276 |
| 6,898,838 | B2 * | 5/2005 | Gordon | 29/559 |
| 7,137,750 | B2 * | 11/2006 | Fujioka et al. | 400/642 |
| RE39,441 | E * | 12/2006 | Wotton et al. | 101/232 |
| 7,384,036 | B2 * | 6/2008 | Kruijt | 271/194 |
| 7,578,629 | B2 * | 8/2009 | Kruijt | 400/645 |
| 8,066,283 | B2 * | 11/2011 | Yamada | 271/276 |
| 8,177,355 | B2 * | 5/2012 | Toya | 347/104 |
| 8,322,844 | B2 * | 12/2012 | Toya | 347/104 |
| 8,356,815 | B2 * | 1/2013 | Yamada | 271/276 |
| 2011/0050823 | A1 * | 3/2011 | Toya et al. | 347/102 |
| 2011/0050824 | A1 * | 3/2011 | Toya et al. | 347/102 |
| 2012/0013669 | A1 * | 1/2012 | Toya | 347/16 |
| 2012/0013670 | A1 * | 1/2012 | Toya | 347/16 |
| 2012/0062638 | A1 * | 3/2012 | Toya | 347/16 |
| 2012/0062672 | A1 * | 3/2012 | Toya | 347/104 |
| 2012/0062674 | A1 * | 3/2012 | Toya | 347/104 |
| 2012/0062680 | A1 * | 3/2012 | Toya | 347/110 |
| 2012/0236100 | A1 * | 9/2012 | Toya | 347/104 |
| 2012/0236101 | A1 * | 9/2012 | Kato et al. | 347/104 |
| 2012/0281037 | A1 * | 11/2012 | Toya | 347/16 |

FOREIGN PATENT DOCUMENTS

JP 2002-205855 A 7/2002

* cited by examiner

*Primary Examiner* — Lee D Wilson
*Assistant Examiner* — Jamal Daniel
(74) *Attorney, Agent, or Firm* — Global IP Counselors, LLP

(57) ABSTRACT

A medium suction support device includes a medium support table, a suction unit, a plurality of flexible tube members and a sliding member. Through-holes are formed in the medium support table to pass through the medium support table. The suction unit is disposed on a side of the back surface to suction the recording medium disposed on the medium support surface via the through-holes. One opening end of each of the flexible tube members surrounds a corresponding one of the through-holes on the back surface. The sliding member is configured to move in parallel along the back surface. The sliding member has openings formed in an opposing surface facing the back surface with each of the openings being configured to respectively accommodate the other opening end of a corresponding one of the flexible tube members. The openings have different lengths in a parallel movement direction of the sliding member.

5 Claims, 8 Drawing Sheets

24
E1
31
A
E2
Ra
26
R2
R (R1)
Ra31
31Ra
53
54
(54e)
(54b)
(54a)
54s
25
50
52
53a
29
(28)
X
Y
Z

MEDIUM SUCTION SUPPORT DEVICE AND MEDIUM CONVEYING DEVICE

CROSS-REFERENCE TO RELATED APPLICATIONS

This application claims priority to Japanese Patent Application No. 2010-092934 filed on Apr. 14, 2010. The entire disclosure of Japanese Patent Application No. 2010-092934 is hereby incorporated herein by reference.

BACKGROUND

1. Technical Field

The present invention relates to a medium suction support device for supporting a recording medium by suction, and a medium conveying device comprising the medium suction support device.

2. Related Art

In inkjet printers and other recording devices, when a recording process is performed on recording paper or another recording medium, the recording medium must be supported on a platen so as to have a certain alignment (a parallel alignment) relative to the recording head.

Particularly when roll paper is used as the recording medium, the end of the roll paper rises up off the platen due to curling, and a paper suction part is therefore provided for suctioning the roll paper to the platen in order to keep the paper from rising.

With this paper suction part, numerous holes are usually provided to the platen, and outside air is sucked in via the suction holes by a fan installed in the reverse side of the platen, thereby holding the roll paper on the platen by suction (negative pressure suction).

When roll paper or another recording medium is placed on a platen and conveyed, not all of the suction holes will necessarily be covered by the recording medium, depending on variations in the size of the recording medium (variations in the dimension in the width direction), the conveyed state (position), and other factors. In other words, since there are open suction holes not covered by the recording medium, air will leak out from these suction holes (air leakage occurs).

When a large number of suction holes are in this open state, the suction force holding the recording medium by suction decreases, and the recording medium is not completely kept from rising.

Therefore, a printer device has been proposed in which a shutter mechanism for incrementally opening and closing the numerous suction holes is provided on the reverse side of the platen in which the numerous suction holes are formed, and the shutter mechanism is operated according to the conveyed state of the recording medium or other factors, as shown in Japanese Laid-Open Patent Publication No. 2002-205855.

SUMMARY

The invention disclosed in Patent Citation 1 has a configuration in which a flat plate-shaped shutter member disposed on the reverse side of the platen is moved back and forth by a cam mechanism. The suction holes of the platen and through-holes formed in the shutter member are made to overlap each other, and the opening surface area of the suction holes is adjusted by the extent of this overlapping.

However, a problem with the invention described above is that air leakage readily occurs, particularly when the invention is applied to a large printer. The platen and the shutter member must be tightly pressed together in order to minimize air leakage when the suction holes of the platen are closed by the shutter member. This is because the platen and the shutter member in a large printer have large surface areas, and it is therefore not necessarily easy to tightly press the two together.

Another problem with the invention described above is that the cost of the device readily increases because a cam mechanism and sensors are used.

The present invention was devised in view of the problems described above, it being an object thereof to provide a medium suction support device and a medium conveying device whereby a recording medium can be reliably held in place by suction.

In the medium suction support device and the medium conveying device according to the present invention, the following means are used in order to resolve the problems described above.

A medium suction support device according to a first aspect includes a medium support table, a suction unit, a plurality of flexible tube members and a sliding member. The medium support table has a medium support surface for supporting a recording medium. A plurality of through-holes is formed in the medium support table to pass through from the medium support surface to a back surface of the medium support table. The suction unit is configured to suction the recording medium disposed on the medium support surface via the through-holes, the suction unit being disposed on a side of the back surface. The tube members correspond to the through-holes with one opening end of each of the flexible tube members surrounding a corresponding one of the through-holes on the back surface. The sliding member has an opposing surface spaced apart from and facing the back surface of the medium support table, and configured to move in parallel along the back surface. The sliding member has a plurality of openings formed in the opposing surface with each of the openings being configured to respectively accommodate the other opening end of a corresponding one of the flexible tube members. The openings have different lengths in a parallel movement direction of the sliding member.

According to the first aspect, suction through the suction holes can be performed when the flexible tube members connected to the suction holes in the back surface of the medium support table are accommodated in the openings of the sliding member. When the sliding member moves in parallel to the medium support table, the other end sides of the flexible tube members separate from the openings of the sliding member and move up onto the sliding member, and the other opening ends are closed off by the sliding member. Air leakage from the suction holes is thereby minimized. Therefore, the recording medium can be reliably held by suction.

In the medium suction support device as described above, the lengths of the openings of the sliding member preferably differ sequentially according to positions of the openings in the parallel movement direction.

The suction holes can thereby be opened and closed incrementally according to the amount by which the sliding member moves in parallel.

In the medium suction support device as described above, a peripheral edge of each of the openings of the sliding member preferably has a surface on which a process for reducing friction with the flexible tube members has been performed.

Air leakage when the suction holes are closed can thereby be minimized over a long period of time.

A medium suction support device according to another aspect includes a medium support table, a suction unit, a sliding member and a plurality of flexible tube members. The medium support table has a medium support surface for supporting a recording medium. A plurality of through-holes is formed in the medium support table to pass through from the medium support surface to a back surface of the medium support table. The suction unit is configured to suction the recording medium disposed on the medium support surface via the through-holes, the suction unit being disposed on a side of the back surface. The sliding member has an opposing surface spaced apart from and facing the back surface of the medium support table, and configured to move in parallel along the back surface. The flexible tube members have one opening ends tightly fixed to the opposing surface of the sliding member, each of the other opening ends of the flexible tube members being configured to respectively surround a corresponding one of the through-holes in the back surface, the other opening ends forming openings with elongated ring shapes having different lengths in a parallel movement direction of the sliding member.

According to this aspect, suction through the suction holes can be performed when the other end sides of the flexible tube members disposed on the sliding member are in contact with areas that do not have suction holes in the back surface of the medium support table. When the sliding member moves in parallel with the medium support table, the other end sides of the flexible tube members surround the suction holes in the back surface of the medium support table. The opening ends of the flexible tube members are thereby fixed to and closed off by the sliding member, and air leakage from the suction holes is thereby minimized. Therefore, the recording medium can be reliably held by suction.

A medium conveying device according to another aspect includes the medium suction support devices as described above, and a medium conveying unit configured and arranged to convey a medium to be supported onto and off from the medium support table.

According to the present invention, satisfactory conveying can be achieved because the recording medium can be reliably held by suction on the medium support table.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the present invention are described hereinbelow with reference to the drawings.

Figure 1:
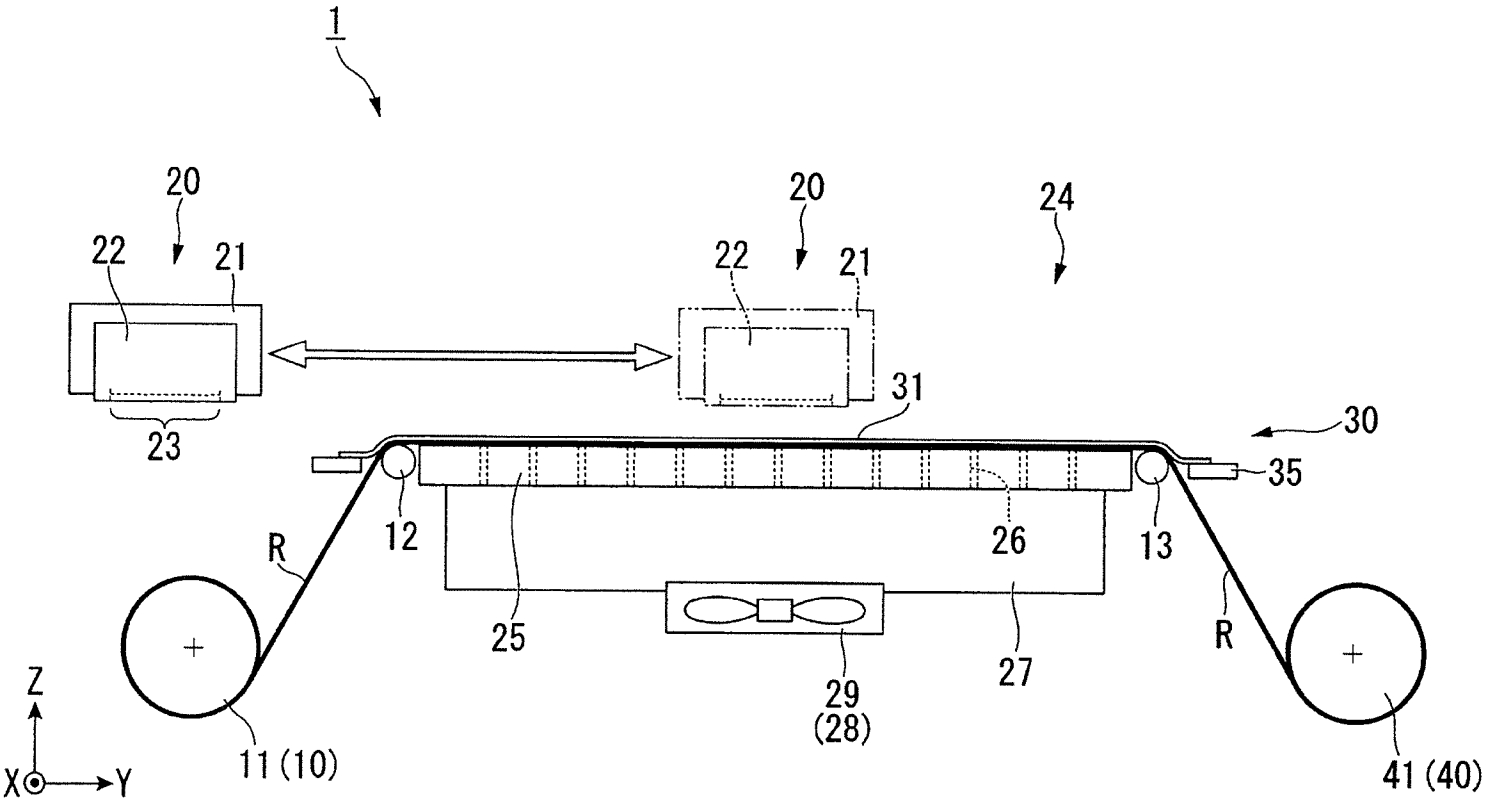
FIG. 1 is a side view showing the schematic configuration of an inkjet printer 1 according to the present embodiment.

FIG. 1 is a side view showing the schematic configuration of an inkjet printer 1 according to the present embodiment.

Figure 2:
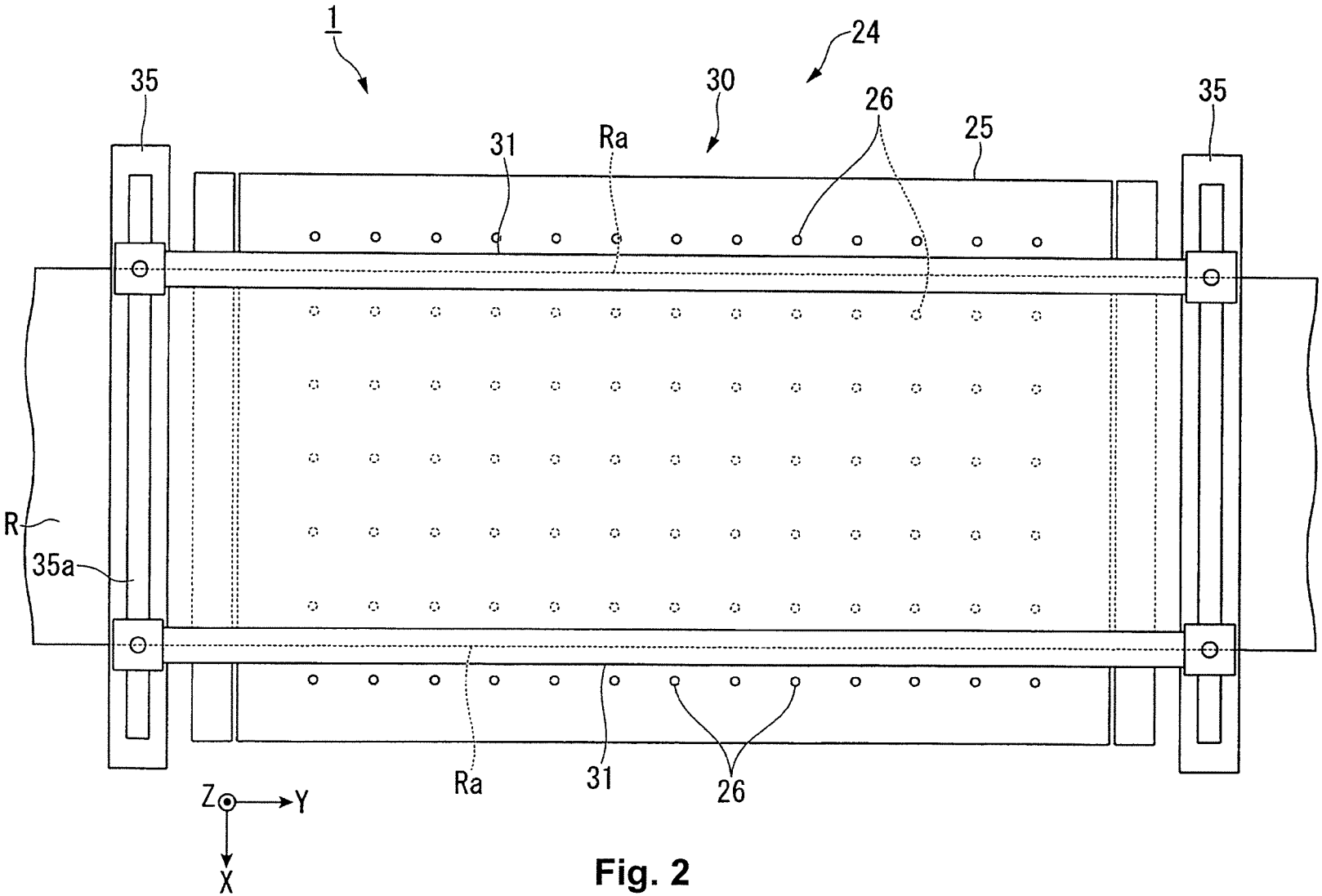
FIG. 2 is a top view showing the schematic configuration of the inkjet printer 1.

FIG. 2 is a top view showing the schematic configuration of the inkjet printer 1.

The inkjet printer 1 (the medium conveying device) comprises a feeding unit 10, a recording unit 20, and an ejection unit 40, as shown in FIG. 1.

The feeding unit (medium conveying unit) 10 is provided so as to be capable of feeding roll paper R, one example of a recording medium (supported medium), to the recording unit 20. Specifically, the feeding unit 10 has a roll medium holder 11, and the roll medium holder 11 holds the roll-shaped roll paper R in place. The configuration is designed so that by rotating the roll-shaped roll paper R, roll paper R unwound from the rolled state can be fed via a first roller 12 to the recording unit 20 downstream in the conveying direction (in the direction of the Y-axis arrow).

The recording unit (the medium conveying unit) 20 is provided so as to be capable of discharging ink, one example of a liquid, to perform recording on the roll paper R fed from the feeding unit 10.

Specifically, the recording unit 20 has a carriage 21, a recording head 22, a medium support table 24, a curl suppressor 30, and other components.

The carriage 21 is made to face the medium support table 24 and is provided so as to be capable of being moved in the feeding direction Y of the roll paper R by the power of a carriage motor (not shown) while being guided along a second guide shaft (not shown).

FIG. 1 shows a state in which the carriage 21 is retracted upstream in the conveying direction from the medium support table 24.

The recording head 22 is provided to the carriage 21 and is provided so as to be capable of moving integrally with the carriage 21 in the conveying direction Y.

Furthermore, the recording head 22 is configured so as to be capable of moving in the width direction X relative to the carriage 21. Specifically, the recording head 22 is provided so as to be capable of being moved in the width direction X by the power of a recording head motor (not shown) while being guided along the second guide shaft (not shown).

Specifically, the recording head 22 is configured so as to be capable of moving in the Y direction (a secondary scanning direction), which is the conveying direction, and the X direction (a primary scanning direction), which is the width direction, within a range of facing the medium support table 24.

Ink is discharged from a nozzle row 23 provided in the surface of the recording head 22 that faces the medium support table 24, whereby the roll paper R can be then be recorded upon.

The medium support table (the medium suction support device) 24 is provided so as to be capable of supporting the roll paper R from the reverse side.

Specifically, the medium support table 24 comprises a platen 25 for supporting the roll paper R, a pressure chamber 27 disposed on the reverse side of the platen 25, a suction mechanism 28 connected to the pressure chamber 27, and other components.

Suction holes 26, which are numerous through-holes having inside diameters of several millimeters, for example, are formed throughout substantially the entire surface of the platen (medium support surface) 25 as shown in FIGS. 1 and 2. Specifically, suction holes 26 having inside diameters of 2 to 3 mm are formed in row arrangements in the Y direction (the conveying direction of the roll paper R), which is the longitudinal direction of the platen 25, and the X direction (the width direction of the roll paper R), which is the width direction.

The pressure chamber (suction unit) 27 is an airtight space whose ceiling is the platen 25, and the suction mechanism 28 is connected to the bottom surface or side surface thereof.

The purpose of the suction mechanism (suction unit) 28 is to suck out the air inside the pressure chamber 27 and create negative pressure. Specifically, the suction mechanism 28 is configured so as to suck out the air inside the pressure chamber 27 by an axial flow fan 29. Outside air is thereby sucked in via the numerous suction holes 26 formed in the platen 25, and the roll paper R placed on the front surface (the top surface) of the platen 25 is held by suction on the front surface of the platen 25.

The medium support table 24 is also provided with a shutter mechanism 50 capable of opening and closing the numerous suction holes 26 formed in the platen 25 as desired, in accordance with variations in the size (variations in the width dimension) of the roll paper R. The configuration and other details of this shutter mechanism 50 will be described hereinafter.

The purpose of the curl suppressor 30 is to prevent so-called rising, in which side ends Ra of the roll paper R curl and separate from the platen 25, by keeping the side ends Ra of the roll paper R placed on the front surface of the platen 25 pressed down on the platen 25.

Specifically, the curl suppressor 30 comprises curl-suppressing members 31 composed of a pair of pliable and flexible belt-shaped films. The curl-suppressing members 31 are disposed at the end sides of the platen 25 in the X direction (the ends in the width direction of the roll paper R), extending along the Y direction (the conveying direction of the roll paper R) and fully across the entire range of the Y direction.

The curl-suppressing members 31 each have a thickness of 0.5 mm or less, and a width of about 30 mm, for example. Polyimide or the like, for example, can be used as their material.

Each of the ends of the curl-suppressing members 31 (their ends in the Y direction) is connected to curl-suppressing attachment parts 35. The curl-suppressing attachment parts 35 are members having substantially the same length as the width direction (the X direction) of the platen 25, and are fixed in place along the width direction to a base (not shown) of the inkjet printer 1 at positions set apart from the ends of the platen 25 in the longitudinal direction (the Y direction).

The ends of the curl-suppressing members 31 are connected to the curl-suppressing attachment parts 35 so as to be capable of moving along the X direction. The curl-suppressing members 31 are thereby disposed in parallel in the longitudinal direction (the Y direction) of the platen 25 at any desired position along the width direction (the X direction) of the platen 25 by moving their ends along the curl-suppressing attachment parts 35.

Therefore, the ends in the width direction (the X direction) of the roll paper R placed on the top surface of the platen 25 can be held down across the entire range of the longitudinal direction (the Y direction).

The ejection unit 40 has a winding roller 41, and the ejection unit 40 is configured so as to wind up the roll paper R fed from the recording unit 20 around the winding roller 41.

The ejection unit 40 also comprises a tensioner for taking out slack in the roll paper R or a drying unit for heating and drying the roll paper R fed from the recording unit 20 when the roll paper R fed from the recording unit 20 is wound up by the winding roller 41.

Next, the configuration of the shutter mechanism 50 provided to the medium support table 24 will be described in detail.

The shutter mechanism 50 is capable of opening and closing the numerous suction holes 26 formed in the platen 25 as desired, in accordance with variations in the size (variations in the width dimension) of the roll paper R as described above.

Figure 3A:
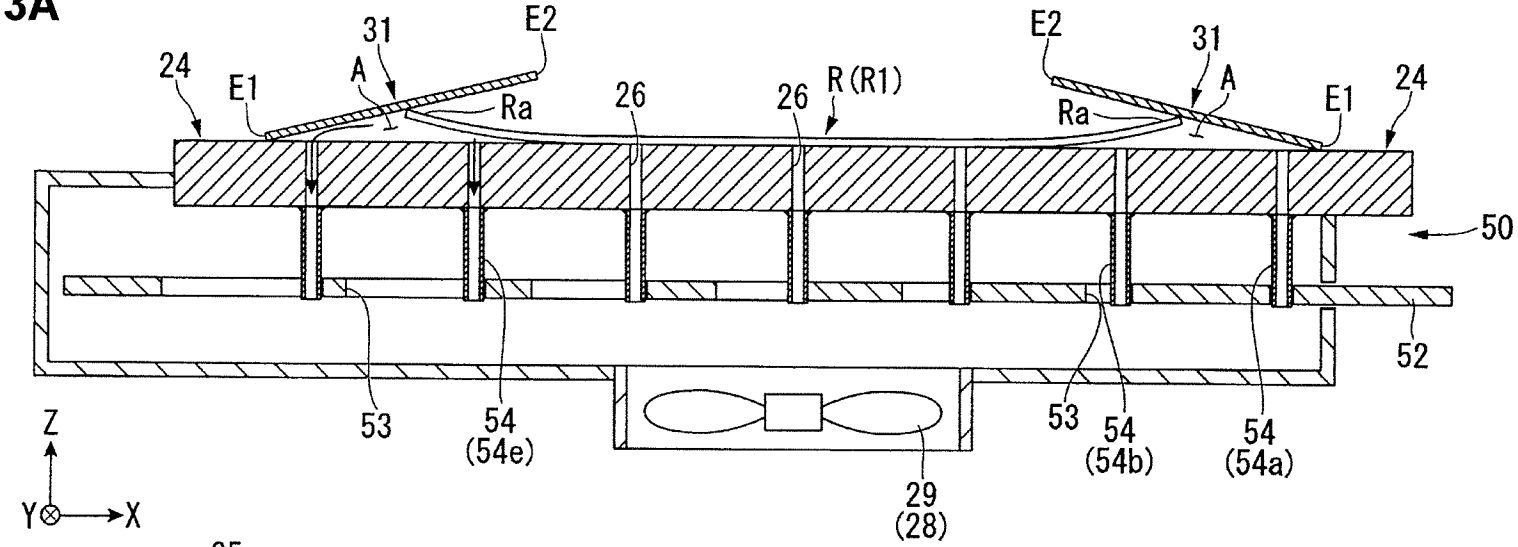
FIGS. 3A and 3B are cross-sectional views schematically showing the configuration of a shutter mechanism 50.
Figure 3B:
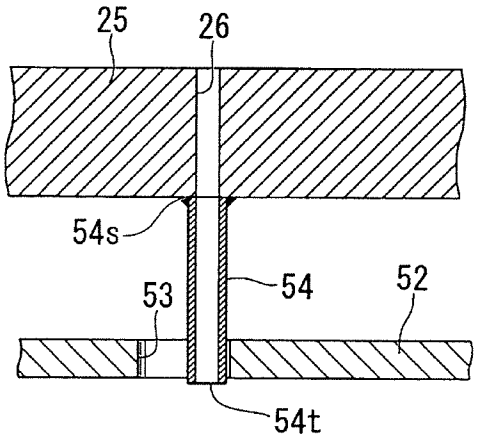

FIGS. 3A and 3B are cross-sectional views schematically showing the configuration of the shutter mechanism 50.

Figure 4:
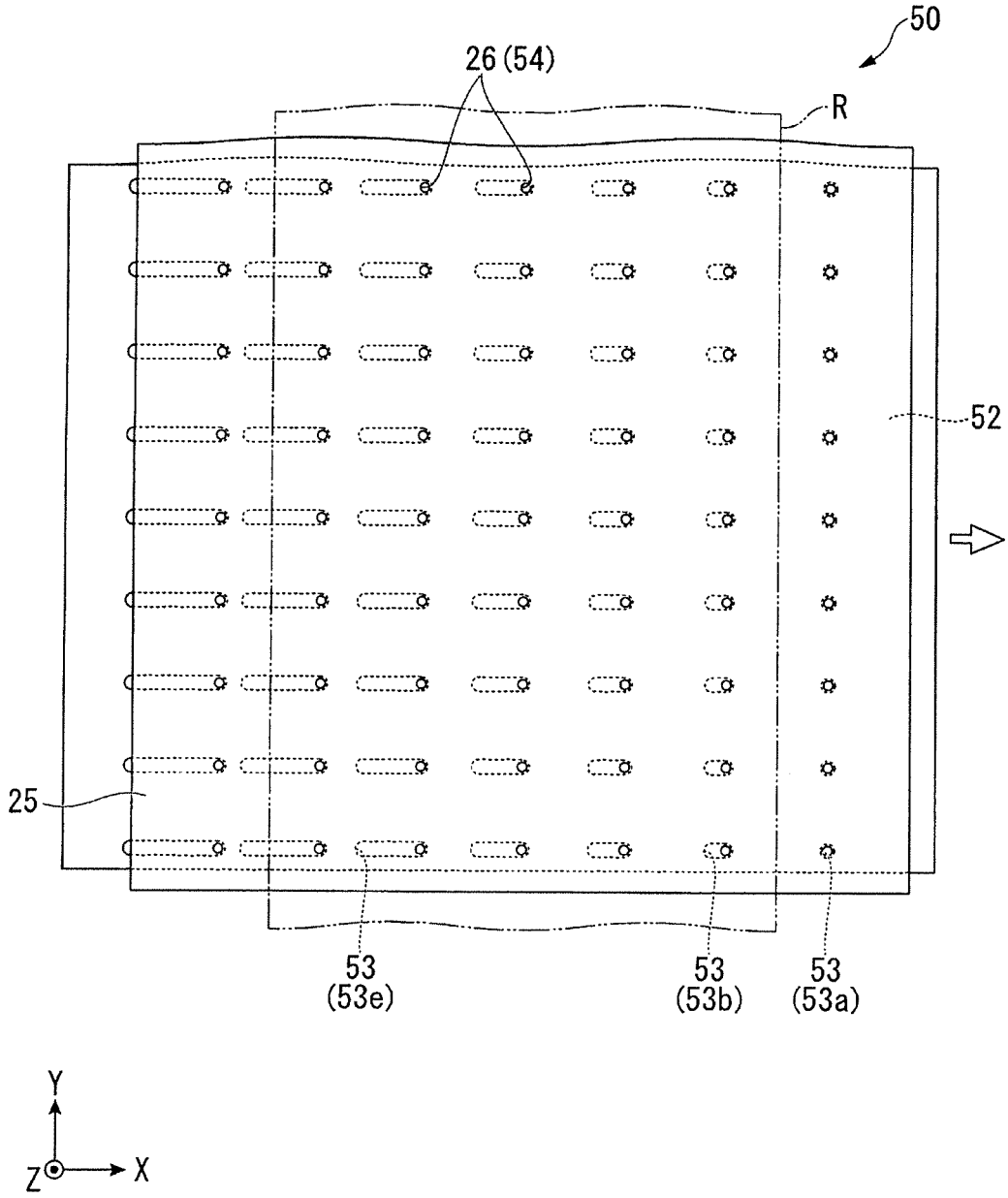
FIG. 4 is a plan view schematically showing the positional relationship between a shutter plate 52 and a platen 25.

FIG. 4 is a plan view schematically showing the positional relationship between a shutter plate 52 and the platen 25.

The shutter mechanism 50 is configured from the shutter plate 52 which is set apart from and which is disposed parallel to the back surface of the platen 25, and numerous flexible tubes 54 connected to the suction holes 26 opened in the back surface of the platen 25.

Numerous openings 53 are formed through the shutter plate (a sliding member) 52. These openings 53 are formed in positions corresponding respectively to the numerous suction holes 26 formed in the platen 25. In other words, when the shutter plate 52 and the platen 25 are viewed from above as shown in FIG. 4, the openings 53 of the shutter plate 52 are formed in an arrangement of rows so as to overlap one-on-one with the suction holes 26 of the platen 25 (the initial state).

The thickness of the shutter plate 52 is preferably several millimeters. Since the shutter plate 52 is moved in parallel as is described hereinafter, this thickness is to reduce the load during this movement. Stainless steel or the like is ideal for the material of the shutter plate 52.

The numerous openings 53 are formed into oval shapes elongated in the X direction. The lengths (major axis dimensions) of the oval shapes of the openings 53 differ depending on where the openings 53 are placed in the X direction (the width direction of the platen 25 and roll paper R).

Specifically, openings 53*a* disposed in one outer side of the shutter plate 52 in the X direction (the +X direction side) are formed as substantial circles. Openings 53*b* adjacent to the openings 53*a* in the −X direction are formed as ovals extending in the −X direction. Furthermore, progressively further along the −X direction, the openings 53*c*, 53*d*, 53*e*, and so forth are formed so that their major axis dimensions alone lengthen incrementally in the −X direction.

For example, when the major axis dimensions (inside diameters) of the openings 53*a* are 6 mm, the major axis dimensions of the openings 53*b* are 12 mm, the major axis dimensions of the openings 53*c* are 18 mm, the major axis dimensions of the openings 53*d* are 24 mm, the major axis dimensions of the openings 53*e* are 30 mm, and so on.

The lengths of the numerous openings 53 in the minor axis direction (the Y direction) are constant at 6 mm, for example. The minor axis lengths are formed so as to be greater than the outside diameters (4 mm) of the flexible tubes 54. This is because the flexible tubes 54 are accommodated in the openings 53 as will be described hereinafter.

Chamfering is performed on the inner peripheral edges of the openings 53. Particularly since the inner peripheral edges of the openings 53 in the major axis direction (the X direction) come in contact with and rub against the flexible tubes 54 as is described hereinafter, various low-friction processes are preferably performed in addition to chamfering.

Furthermore, the shutter plate 52 is configured so as to be capable of being moved in parallel manually or automatically in the X direction (the width direction of the platen 25 and roll paper R) while set apart from and disposed parallel to the back surface of the platen 25. Specifically, the shutter plate 52 can be moved in parallel in the +X direction incrementally at a spacing (pitch) of 6 mm, for example. In other words, the shutter plate 52 can be moved in parallel in the X direction from the initial position shown in FIG. 4 to positions of 6 mm, 12 mm, 18 mm, 24 mm, 30 mm, and so on.

Most of the shutter mechanism 50 is accommodated substantially inside the pressure chamber 27. Since the shutter plate 52 moves in parallel in the +X direction along the platen 25, the shutter plate 52 is disposed so that one end protrudes outside of the pressure chamber 27.

In other words, an opening through which part (one end) of the shutter plate 52 is inserted is provided in a side wall of the pressure chamber 27. This opening is provided with an air-tight mechanism (not shown) so that air does not leak out. By inserting the shutter plate 52 through the opening in the side wall of the pressure chamber 27 and pulling the shutter plate 52 out in the +X direction from this opening, the shutter plate 52 can be moved in parallel in the +X direction.

The flexible tubes (flexible tube members) 54 are connected respectively to the suction holes 26 opened in the back surface of the platen 25. The flexible tubes 54 are tubular members, circular in cross section, which are formed from silicon rubber or another pliable and flexible material, for example, and are connected (secured) using an adhesive or the like so that the suction holes 26 in the back surface of the platen 25 are enclosed (surrounded) without any gaps by opening ends 54*s* of the flexible tubes 54.

The opening ends 54*s* of the flexible tubes 54 may enclose the suction holes 26 by being firmly affixed to the back surface of the platen 25, or the opening end 54*s* sides may be fitted into the suction holes 26. Another option is to fit pipe joints to the suction holes 26 and insert the opening end 54*s* sides of the flexible tubes 54 into the pipe joints.

The flexible tubes 54 extend downward in a substantially linear manner from the back surface of the platen 25, and are inserted (accommodated) from the other opening end 54*t* side respectively in the openings 53 of the shutter plate 52, as shown in FIG. 3B.

Furthermore, the other opening end 54*t* sides of the flexible tubes 54 extend to positions several millimeters below the back surface of the shutter plate 52, for example.

Next, the action of the shutter mechanism 50 comprising the above-described configuration will be described.

As described above, in the state shown in FIG. 4, i.e. the initial state of the shutter mechanism 50 (the initial position of the shutter plate 52), the flexible tubes 54 connected respectively to the suction holes 26 opened in the back surface of the platen 25 are accommodated in the openings 53 (53*a*, 53*b*, 53*c*, 53*d*, 53*e*, and so forth) formed in the shutter plate 52. In other words, all of the flexible tubes 54 are inserted one-to-one into all of the openings 53.

The suction mechanism 28 connected to the pressure chamber 27 of the medium support table 24 is driven in this initial state. In other words, the axial flow fan 29 is made to rotate, creating negative pressure inside the pressure chamber 27.

Air (outside air) above the front surface (the top surface) of the platen 25 is then sucked in via all of the suction holes 26 of the platen 25 and all of the flexible tubes 54 connected to the suction holes 26.

The roll paper R placed on the front surface (the top surface) of the platen 25 can thereby be held by suction on the front surface of the platen 25.

More specifically, the action takes place as shown hereinbelow.

Figure 5:
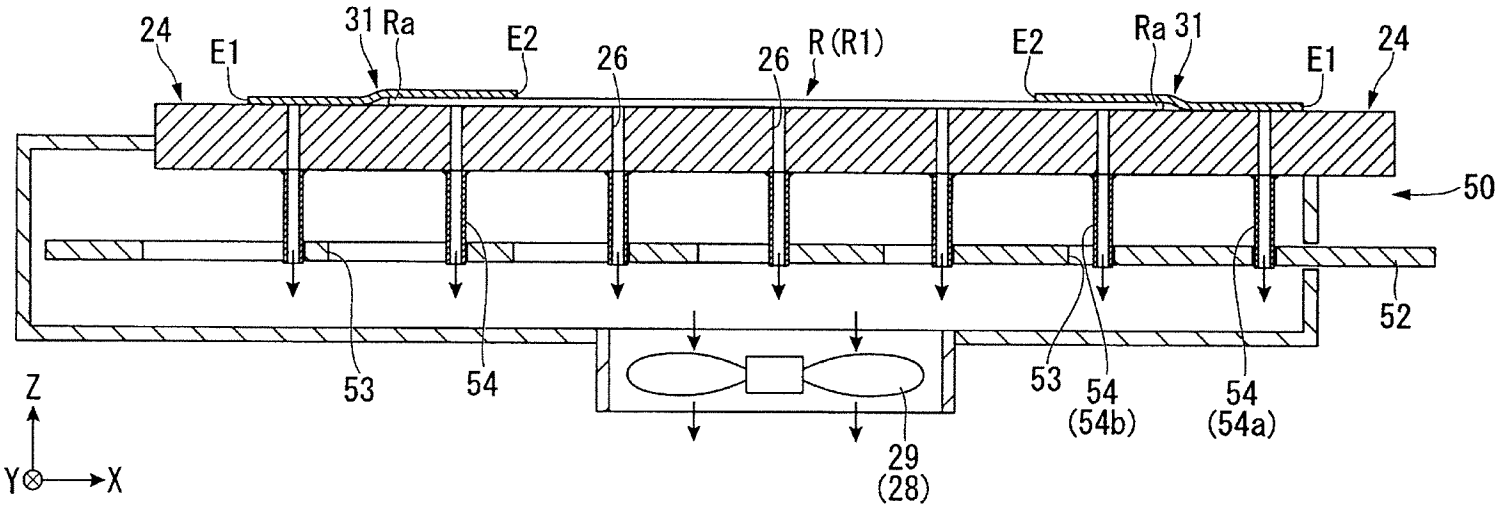
FIG. 5 is a schematic front cross-sectional view showing the action when a suction mechanism 28 of a medium support table 24 is driven.

FIG. 5 is a schematic front cross-sectional view showing the action when the suction mechanism 28 of the medium support table 24 is driven.

FIGS. 3A and 5 show a case in which the width dimension (the length in the X direction) of the roll paper (the supported medium) R1 is substantially equal to the width dimension of the platen 25.

First, with the roll paper R having been fed onto the platen 25, an operator aligns the X-direction positions of the pair of curl-suppressing members 31 with positions facing the side ends Ra of the roll paper R, as shown in FIG. 3A.

Specifically, the curl-suppressing members 31 are disposed on top of the side ends Ra of the roll paper R. In other words, the curl-suppressing members 31 are disposed so as to cover the side ends Ra of the roll paper R. To be more exact, the curl-suppressing members 31 are disposed so as to extend over the side ends Ra of the roll paper R in the X direction.

In other words, outside ends E1 of the curl-suppressing members 31 are brought in contact with the platen 25 farther to the outside than the side ends Ra of the roll paper R. Inside ends E2 of the curl-suppressing members 31 are disposed so as to be positioned farther inside than the side ends Ra of the roll paper R and are brought in contact with the side ends Ra of the roll paper R.

Since a downward-pressing force acts on the pair of curl-suppressing members 31, the outside ends E1 of the pair of curl-suppressing members 31 can be brought in at least linear contact with the platen 25. Similarly, the surfaces of the pair of curl-suppressing members 31 on the sides with the inside ends E2 can be brought in contact with the side ends Ra of the roll paper R.

As described above, the suction holes 26 are provided to the front surface (the top surface) of the platen 25, at least in areas that face the side ends Ra of the roll paper R and the curl-suppressing members 31. Therefore, the driving of the suction mechanism 28 causes the air in spaces A enclosed by the platen 25, the roll paper R, and the curl-suppressing members 31 to be sucked in via the suction holes 26.

Therefore, the roll paper R and the pair of curl-suppressing members 31 come to be in tight contact with the platen 25 as shown in FIG. 5. Specifically, they come to be held by suction on the medium support table 24.

The roll paper R1 placed on the front surface (the top surface) of the platen 25 can thus be held by suction on the front surface of the platen 25. In particular, by providing the pair of curl-suppressing members 31, the side ends Ra of the roll paper R can be kept in firm contact with the platen 25.

The following is a description of a case in which roll paper (a supported medium) R2 having a narrower (shorter) width dimension (the length in the X direction) than the roll paper R1 is held by suction on the medium support table 24 instead of the roll paper R1.

Figures 6A, 6B, 6C:
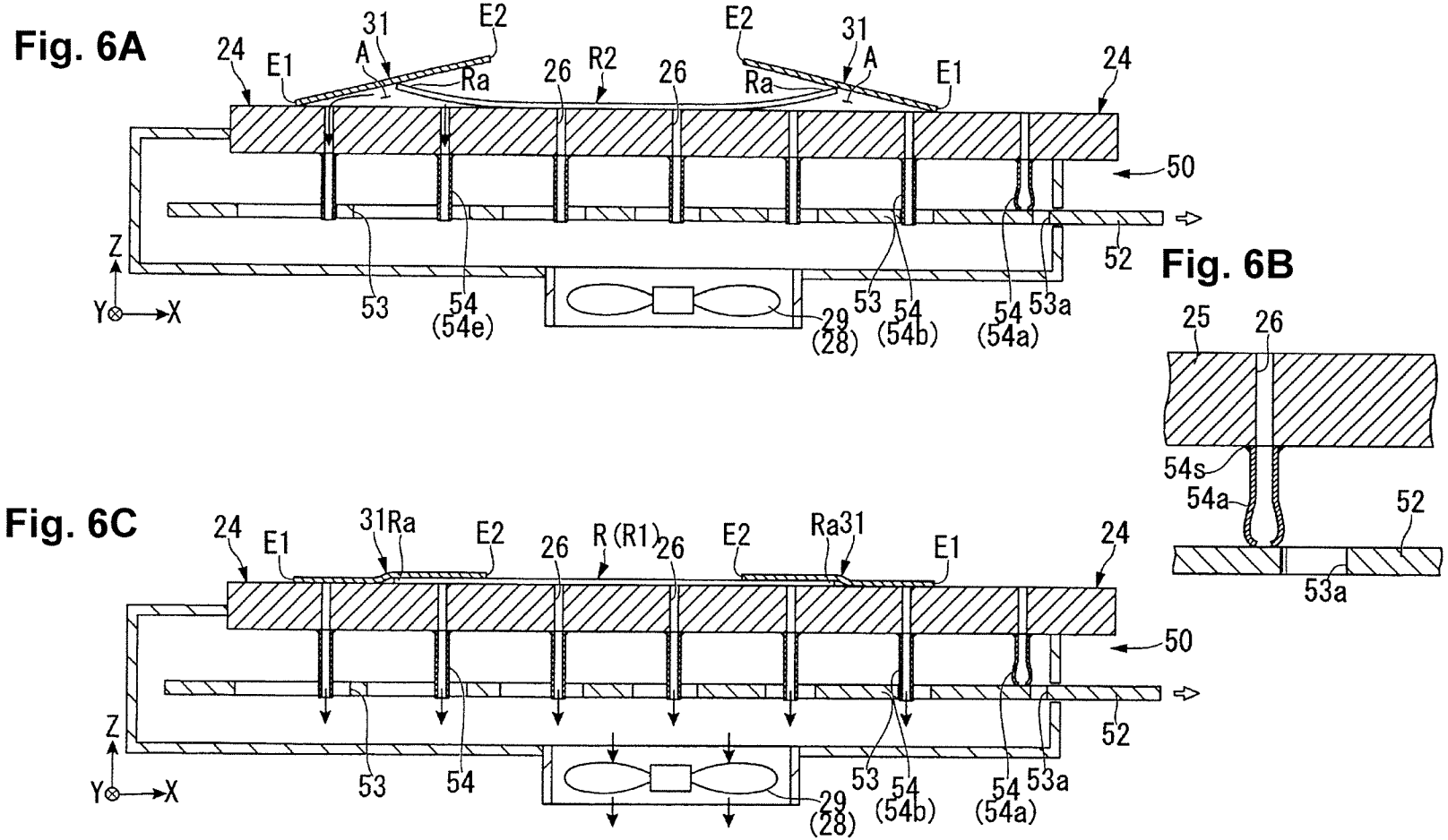
FIGS. 6A to 6C are schematic cross-sectional views showing a case in which the shutter plate 52 has been moved one increment in the X direction from the initial position.

FIGS. 6A to 6C are schematic cross-sectional views showing a case in which the shutter plate 52 has been moved one increment in the X direction from the initial position.

For example, the width dimension of the roll paper R2 is narrower than that of the roll paper R1 by the pitch (one pitch) with which the suction holes 26 are disposed in the X direction. When the roll paper R2 is placed on the top surface of the medium support table 24, it is placed by so-called one-side alignment (end-part referencing).

When the width dimension of the roll paper R placed on the medium support table 24 is narrower than that of the roll paper R1, the operator moves the shutter plate 52 in parallel in the +X direction from the initial position (see FIG. 4) before driving the suction mechanism 28.

In the case of the roll paper R2, since the width dimension is narrower than that of the roll paper R1 by the pitch (one pitch) with which the suction holes 26 are disposed in the X direction, the shutter plate 52 is moved 6 mm (one increment) in the +X direction from the initial position.

As described above, in the initial state of the shutter mechanism 50 (the initial position of the shutter plate 52), the flexible tubes 54 connected respectively to the suction holes 26 opened in the back surface of the platen 25 are accommodated in the openings 53 (53*a*, 53*b*, 53*c*, 53*d*, 53*e*, and so forth) formed in the shutter plate 52.

From this initial state, when the shutter plate 52 is driven 6 mm in the +X direction, only the flexible tubes 54*a* accommodated in the openings 53*a* come out of the openings 53*a* and move up onto the top surface of the shutter plate 52. At this time, since the flexible tubes 54 are very pliable and flexible and their lengths are adjusted to be somewhat longer than the distance from the platen 25 to the shutter plate 52, the other opening ends 54*t* come in contact so as to be firmly pressed to the top surface of the shutter plate 52 as shown in FIG. 6B.

The other opening ends 54*t* of the flexible tubes 54*a* are then closed off by the shutter plate 52. Therefore, it will no longer be possible for outside air to be sucked in via the flexible tubes 54*a* even if the suction mechanism 28 is driven, as will be described hereinafter.

The other opening ends 54*t* of the flexible tubes 54*a* do not need to be completely closed off by the shutter plate 52. The intake of outside air may be impeded (resistance increased) in comparison with the other flexible tubes 54*b* and so forth. In other words, parts of the flexible tubes 54*a* are crushed, compressed (constricted), or bent, and may be substantially smaller in innermost diameters than the other flexible tubes 54*b* and so on.

At the same time that the shutter plate 52 moves in the +X direction, one of the curl-suppressing members 31 is moved in the +X direction and aligned in a position facing the side end Ra of the roll paper R2.

By driving the suction mechanism 28, the roll paper R2 comes to be held by suction on the medium support table 24 as shown in FIG. 6C.

At this time, there is no roll paper R2 or curl-suppressing member 31 above the suction holes 26*a* disposed farthest in the +X direction from among the numerous suction holes 26 formed in the platen 25.

Therefore, when the suction mechanism 28 in a conventional medium support table is driven, outside air is constantly being sucked in through the suction holes 26*a*, the suction force decreases in the other suction holes 26*b*, 26*c*, 26*d*, 26*e*, and so on, and there are cases in which the roll paper R2 cannot be sufficiently held by suction on the medium support table 24.

With the medium support table 24, since moving the shutter plate 52 in the +X direction closes off the other opening ends 54*t* of the flexible tubes 54*a* connected to the outermost (in the +X direction) suction holes 26*a*, outside air ceases for the most part to be sucked in through the suction holes 26*a*. Therefore, there is no decrease in the suction force of the other suction holes 26*b*, 26*c*, 26*d*, 26*e*, and so on.

In other words, even in the case of the roll paper R2 having a narrower width dimension than the roll paper R1, substantially the same suction force as that in the case of the roll paper R1 can be maintained and the roll paper R2 can be held by suction on the top surface of the medium support table 24 (the platen 25).

Furthermore, when roll paper (a supported medium) R3 or the like having a narrower (shorter) width dimension (the length in the X direction) than the roll paper R1 or R2 is held by suction on the medium support table 24, the operator moves the shutter plate 52 and the curl-suppressing members 31 in parallel in the X direction in accordance with the width dimension.

Assuming there is no roll paper R3 or curl-suppressing member 31 above the suction holes 26*a* through 26*d*, for example, the shutter plate 52 is moved some integral multiple of 6 mm in the +X direction from the initial position. Specifically, the shutter plate 52 is moved 24 mm (four increments).

The flexible tubes 54*a* to 54*d* from among the flexible tubes 54 thereby separate from the respective openings 53*a* to 53*d* and move up onto the top surface of the shutter plate 52. Therefore, the other opening ends 54*t* of the flexible tubes 54*a* to 54*d* are firmly pressed to the top surface of the shutter plate 52 and closed off.

Consequently, outside air is not sucked in through the suction holes 26*a* to 26*d* corresponding to the flexible tubes 54*a* to 54*d* even when the suction mechanism 28 is driven, and there is no decrease in the suction force of the other suction holes 26*e* and so on.

Thus, even when roll paper R (R1, R2, R3, and so forth) having different width dimensions is suctioned to the top surface of the medium support table 24, a substantially equal suction force can be maintained to hold the roll paper by suction.

As described above, with the inkjet printer 1 according to the present embodiment, outside air can be sucked in through all of the suction holes 26 to hold the roll paper R1 by suction in a state in which all of the flexible tubes 54 connected to the suction holes 26 in the back surface of the medium support table 24 are accommodated in the openings 53 of the shutter plate 52.

When roll paper R2, R3, and so on having different width dimensions is substituted, the shutter plate 52 is moved in parallel with the platen 25, whereby the other opening end 54*t* sides of the flexible tubes 54 separate from the openings 53 of the shutter plate 52 and move up onto the shutter plate 52, and the other opening ends 54*t* are closed off by the shutter plate 52. Air leakage from the suction holes 26 is thereby minimized. Therefore, the roll paper R can be reliably held in place by suction.

Since the openings 53 of the shutter plate 52 differ in sequence and opening length (major axis dimension) according to their positions in the X direction (the parallel movement direction), the suction holes 26 can be opened and closed incrementally and selectively in accordance with the amount of parallel movement of the shutter plate 52.

Since the parallel movement direction of the shutter plate 52 coincides with the width direction of the roll paper R1, R2, R3, and so on, the suction holes 26 can be appropriately opened and closed according to the variations in the width dimension of the roll paper R1, R2, R3, and so on.

Subjecting the peripheral edges of the openings 53 of the shutter plate 52 to a process for reducing friction with the flexible tubes 54 allows the air leakage when the suction holes 26 are closed off to be minimized over a longer period of time. As described above, the other opening end 54*t* sides of the flexible tubes 54 separate from the openings 53 of the shutter plate 52 and move up onto the shutter plate 52. By reducing abrasion at this time, scratching of the flexible tubes 54 can be minimized and the reliability of the device can be maintained.

Specifically, the peripheral edges of the openings 53 in the X direction can be chamfered, the peripheral edge shapes can be fashioned into circular or elliptical shapes, or other such processes performed. The other opening ends 54*t* of the flexible tubes 54 thereby move more readily up onto the top surface of the shutter plate 52.

Furthermore, the friction resistance may be reduced by a chemical treatment. Specifically, a fluororesin or another low-friction coating may be applied.

Since only the other opening end 54*t* sides of the flexible tubes 54 come in contact with the shutter plate 52, the contact surface area is small, and the load during the parallel movement of the shutter plate 52 can therefore be kept to a minimum. In other words, the shutter plate 52 can be moved in parallel with a small amount of force. For example, in cases in which the parallel movement of the shutter plate 52 is automated, a small motor or the like can be used and the cost of the device is therefore minimized.

Since the shapes of the openings 53 of the shutter plate 52 are formed so as to incrementally differ progressively in the +X direction, the movement distance of the shutter plate 52 can be kept to a minimum. Therefore, the surface area for installing the device can also be kept to a minimum.

In the present embodiment described above, a case of one shutter plate 52 was described, but the present invention is not limited thereto.

Figure 7:
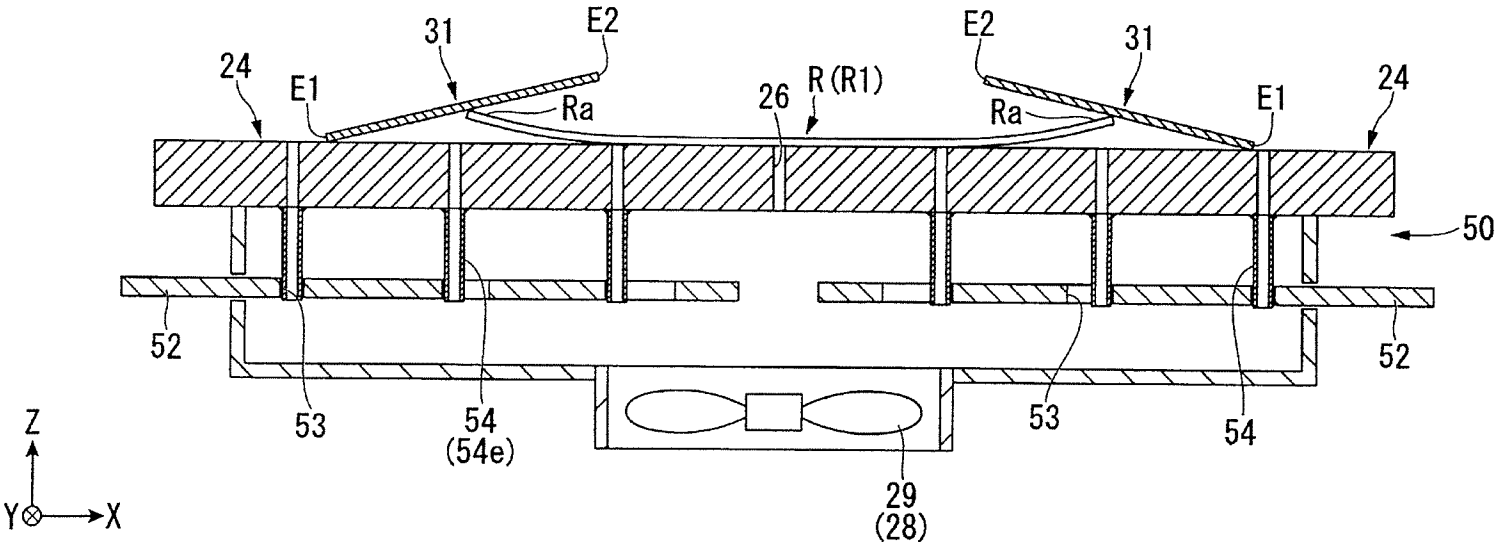
FIG. 7 is a schematic view showing a modification of the shutter mechanism 50.

For example, another option is a configuration in which two shutter plates 52 are disposed so as not to overlap, the shutter plates having linear symmetry about the center of the medium support table 24 in the X direction, as shown in FIG. 7, and the shutter plates 52 move toward the outsides of the medium support table 24. FIG. 7 shows the shutter plates 52 as being in the initial position.

In this case, when the roll paper R1, R2, R3, and so on are placed on the top surface of the medium support table 24, they are placed by so-called center alignment (center referencing).

The flexible tubes 54 do not need to be connected (fixed) to all of the suction holes 26 of the platen 25, as shown in FIG. 7. The holes may be always left in the opened state, without the flexible tubes 54 being connected to the suction holes 26 that are always covered by the roll paper R.

In the embodiment described above, a case was described in which the shutter plate 52 had substantially the same surface area as the platen 25, but the present invention is not limited thereto. Specifically, since it should be possible to adapt to variations in the width direction (the X direction) of the roll paper R, a shutter plate 52 need be disposed merely on the outer side of the platen 25 in the X direction. In other words, in the center of the platen 25 in the X direction, the suction holes 26 need not be opened and closed.

Lastly, another embodiment of the shutter mechanism will be described.

Figure 8A:
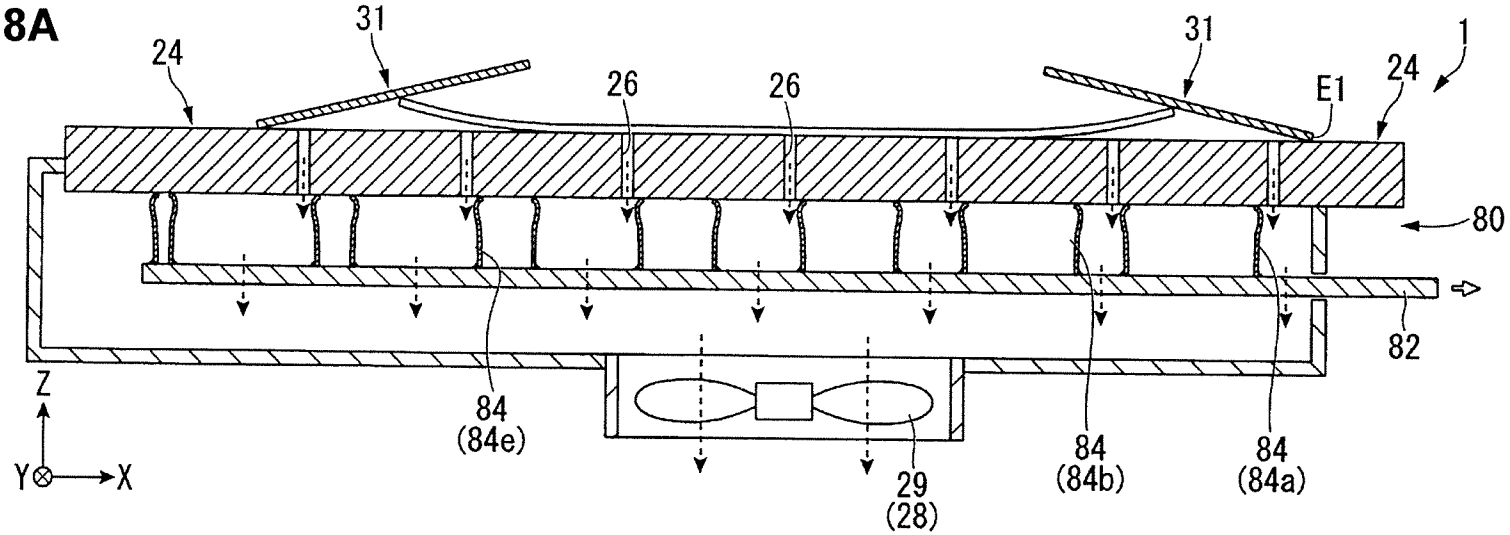
FIGS. 8A and 8B are cross-sectional views schematically showing a shutter mechanism 80 according to another embodiment.
Figure 8B:
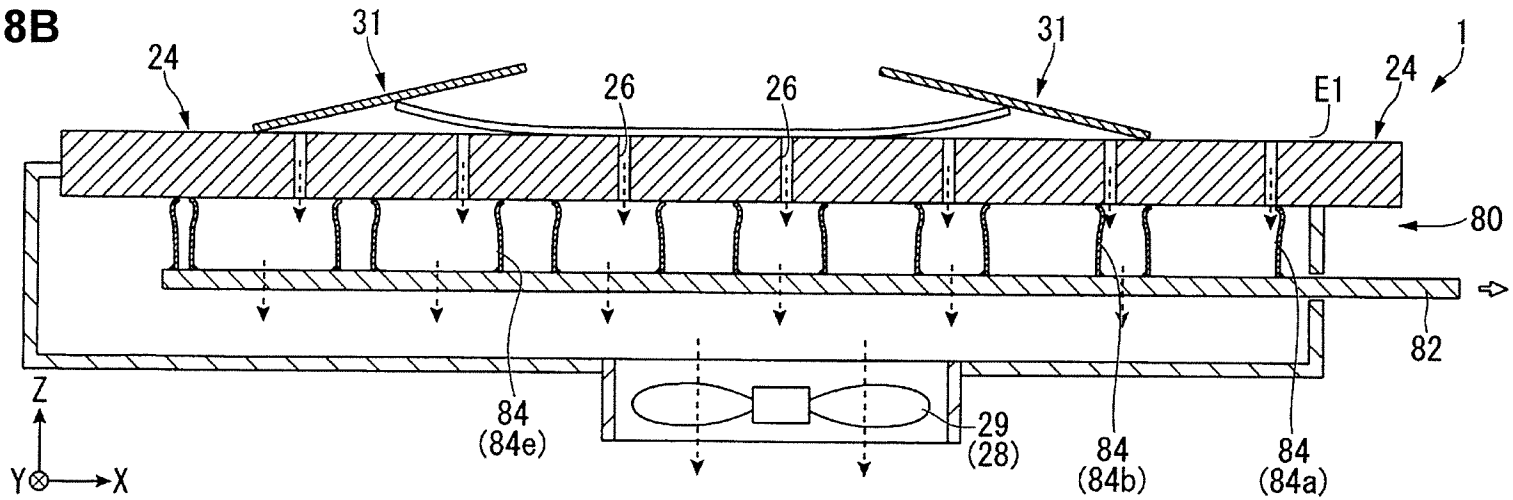

FIGS. 8A and 8B are cross-sectional views and plan view schematically showing a shutter mechanism 80 according to another embodiment.

Members and other features identical to those of the shutter mechanism 50 are denoted by the same symbols and are not described, while the description focuses primarily on different members and other features.

The shutter mechanism 80 comprises a shutter plate 82 which is capable of moving in parallel in the X direction while disposed separate from and parallel to the back surface of the platen 25, similar to the shutter plate 52.

Openings 53 are not provided to the shutter plate (the sliding member) 82, and instead of the openings 53, other ends 84*t* of flexible tubes 84 are firmly adhered and fixed in place directly.

Similar to the flexible tubes 54, the flexible tubes 84 are formed from, for example, silicon rubber or another pliable and flexible material. Opening ends 84*s* thereof come in contact so as to press firmly to the back surface of the platen 25. The opening ends 84*s* are not fixed to the back surface of the platen 25, but are designed so slide along with the movement of the shutter plate 82 while in contact with the back surface.

The flexible tubes (flexible tube members) 84 are arranged in rows in positions that do not overlap the suction holes 26 of the platen 25 (the initial state). When the shutter plate 82 has been moved as far as possible in the +X direction, the flexible tubes 84 are moved to positions where they overlap the suction holes 26 one-to-one.

The flexible tubes 84 are tubular members which are shaped as ovals (long rings) in cross section, unlike the flexible tubes 54. The flexible tubes 84 are formed so that their cross-sectional shapes are ovals extending along the X direction. The lengths (major axis dimensions) of the ovals of the flexible tubes 84 are formed so as to become incrementally shorter in accordance with where the flexible tubes 84 are disposed in the X direction.

Specifically, the major axis dimension (inside diameters) of the flexible tubes 84*a* is 42 mm, the major axis dimension of the flexible tubes 84*b* is 36 mm, the major axis dimension of the flexible tubes 84*c* is 30 mm, the major axis dimension of the flexible tubes 84*d* is 24 mm, the major axis dimension of the flexible tubes 84*e* is 18 mm, and so on.

This shutter mechanism 80 operates in the same manner as the shutter mechanism 50.

Specifically, in the initial state of the shutter mechanism 80 (the initial position of the shutter plate 82), the flexible tubes 84 fixed to the shutter plate 82 come in contact at the opening ends 84*s* in areas set apart from the suction holes 26 opened in the back surface of the platen 25, as shown in FIG. 8A. Therefore, all of the suction holes 26 become opened, and the roll paper R1 can be held by suction on the platen 25.

Next, when the shutter plate 82 has been moved 6 mm (one increment) in the +X direction, the opening ends 84*s* of the flexible tubes 84*a* move to areas overlapping the suction holes 26*a* of the platen 25 and enclose (surround) the suction holes 26*a* without any gaps, as shown in FIG. 8B. Therefore, the suction holes 26*a* become closed off, and roll paper R2 of a narrower width dimension can be satisfactorily held by suction on the platen 25.

Furthermore, when the shutter plate 82 has been moved an integer multiple of 6 mm (multiple increments) in the +X direction, the opening ends 84*s* of the flexible tubes 84*b* and so on are moved to areas overlapping the suction holes 26*b* and so on of the platen 25, and the suction holes 26*b* and so on are enclosed (surrounded) without any gaps. Therefore, the suction holes 26*a*, 26*b*, and so on become closed off, and roll paper R3 and so on of a narrower width can be satisfactorily held by suction on the platen 25.

Thus, the suction holes 26 can be incrementally and selectively closed or opened according to the position of the shutter mechanism 80 in the X direction (the parallel movement direction).

In the embodiment described above, all inkjet printer was described as an example of a recording device (a liquid ejection device), but the recording device is not limited to an inkjet printer and may be a copy machine, a fax machine, or another device.

In the embodiment described above, roll paper R was given as an example of a recording medium in the description, but the medium may also be single sheets of paper or a film.

The flexible tubes 54, 84 may have pleated shapes, for example. This is because the flexible tubes can be made flexible and pliable by being given pleated shapes, regardless of the characteristics of their materials.

In the embodiment described above, a liquid ejection device for ejecting ink or another liquid was used as an example of the recording device in the description, but the present invention can also be applied to a liquid ejection device which ejects or discharges a liquid other than ink. The liquids that can be ejected by the liquid ejection device include liquid substances or gel-like fluid substances in which particles of a functional material have been dispersed or dissolved.

In the embodiment described above, the liquid ejected from the liquid ejection device (the recording device) need not be ink, and a liquid corresponding to a particular application can be applied. A predetermined device can be manufactured by providing a liquid ejection device with an ejection head capable of ejecting the liquid corresponding to the particular application, ejecting the liquid corresponding to the particular application from the ejection head, and depositing the liquid on a predetermined substance. For example, the liquid ejection device can be used as a liquid ejection device for ejecting a liquid (a liquid substance) containing a dispersion (solution) in a predetermined dispersion medium (solvent) of an electrode material, a coloring material, or another material used for purposes such as manufacturing liquid crystal displays, EL (electroluminescence) displays, and surface-emitting displays (FEDs).

The fluid ejection device may also be a liquid ejection device for ejecting a bioorganic substance used to manufacture biochips, or a liquid ejection device used as a precision pipette to eject a liquid as a test sample.

Furthermore, the liquid ejection device may be a liquid ejection device for ejecting lubricating oil at pinpoint position onto a timepiece, a camera, or another precision instrument; a liquid ejection device for ejecting an ultraviolet-curing resin or another transparent resin onto a substrate in order to form tiny semispherical lenses (optical lenses) or other components used in optical communication elements or the like; a liquid ejection device for ejecting an acid, an alkali, or another etching liquid in order to etch a substrate or the like; or a fluid ejection device for ejecting a gel. The present invention can be applied to any one of these liquid ejection devices.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A medium suction support device comprising:

a medium support table having a medium support surface for supporting a recording medium, a plurality of through-holes being formed in the medium support table to pass through from the medium support surface to a back surface of the medium support table;

a suction unit configured to suction the recording medium disposed on the medium support surface via the through-holes, the suction unit being disposed on a side of the back surface;

a plurality of flexible tube members corresponding to the through-holes with one opening end of each of the flexible tube members surrounding a corresponding one of the through-holes on the back surface; and a sliding member having an opposing surface spaced apart from and facing the back surface of the medium support table, and configured to move in parallel along the back surface, the sliding member having a plurality of openings formed in the opposing surface with each of the openings being configured to respectively accommodate the other opening end of a corresponding one of the flexible tube members, the openings having different lengths in a parallel movement direction of the sliding member.

2. The medium suction support device according to claim 1, wherein the lengths of the openings of the sliding member differ sequentially according to positions of the openings in the parallel movement direction.

3. The medium suction support device according to claim 1, wherein a peripheral edge of each of the openings of the sliding member has a surface on which a process for reducing friction with the flexible tube members has been performed.

4. A medium suction support device comprising:

a medium support table having a medium support surface for supporting a recording medium, a plurality of through-holes being formed in the medium support table to pass through from the medium support surface to a back surface of the medium support table;

a suction unit configured to suction the recording medium disposed on the medium support surface via the through-holes, the suction unit being disposed on a side of the back surface;

a sliding member having an opposing surface spaced apart from and facing the back surface of the medium support table, and configured to move in parallel along the back surface; and a plurality of flexible tube members having one opening ends tightly fixed to the opposing surface of the sliding member, each of the other opening ends of the flexible tube members being configured to respectively surround a corresponding one of the through-holes in the back surface, the other opening ends forming openings with elongated ring shapes having different lengths in a parallel movement direction of the sliding member.

5. A medium conveying device comprising:

the medium suction support device according to claim 1; and a medium conveying unit configured and arranged to convey a medium to be supported onto and off from the medium support table.

* * * * *